US008869374B2

(12) United States Patent
Bense et al.

(10) Patent No.: US 8,869,374 B2
(45) Date of Patent: Oct. 28, 2014

(54) METHOD AND A DEVICE FOR THE FORMATION OF AN OVERLAP JOINT

(75) Inventors: Rolf Bense, Jork (DE); Eugen Gorr, Hamburg (DE); Tim Strohbach, Ottersberg (DE)

(73) Assignee: Airbus Operations GmbH (DE)

( * ) Notice: Subject to any disclaimer, the term of this patent is extended or adjusted under 35 U.S.C. 154(b) by 49 days.

(21) Appl. No.: 13/327,909

(22) Filed: Dec. 16, 2011

(65) Prior Publication Data

US 2012/0159770 A1 Jun. 28, 2012

Related U.S. Application Data

(60) Provisional application No. 61/426,554, filed on Dec. 23, 2010.

(30) Foreign Application Priority Data

Dec. 23, 2010 (DE) ..... 10 2010 064 144
Nov. 24, 2011 (DE) ..... 10 2011 087 007

(51) Int. Cl.
*B21J 15/02* (2006.01)
*B21J 15/14* (2006.01)

(52) U.S. Cl.
CPC ..... *B21J 15/142* (2013.01)
USPC ..... 29/525.06; 29/897.2; 29/243.53; 29/56.6

(58) Field of Classification Search
USPC ..... 408/95, 97, 98, 77, 78
See application file for complete search history.

(56) References Cited

U.S. PATENT DOCUMENTS 6,210,084 B1 * 4/2001 Banks et al. ..... 408/97
8,365,376 B2 * 2/2013 Reid et al. ..... 29/243.54

FOREIGN PATENT DOCUMENTS

DE 3733534 A1 * 4/1989 ..... B08B 15/04

OTHER PUBLICATIONS

Translation of DE3733534.*

* cited by examiner

*Primary Examiner* — Alexander P Taousakis
*Assistant Examiner* — Matthew P Travers
(74) *Attorney, Agent, or Firm* — Carter, DeLuca, Farrell & Schmidt, LLP

(57) ABSTRACT

Disclosed are a method and a device for the connection of two components indirectly or directly in an overlap joint, wherein component sections located in the overlap are pressed together for each drilling procedure by means of a clamping unit formed from a pressure application device on the drilling machine side and a guide on the component side, such that any penetration of chips between the component sections is prevented and temporary connecting elements can be dispensed with.

11 Claims, 2 Drawing Sheets

METHOD AND A DEVICE FOR THE FORMATION OF AN OVERLAP JOINT

TECHNICAL FIELD

The invention concerns a method for purposes of connecting two components in an overlap joint, and also a device for the execution of such a method.

BACKGROUND OF RELATED ART

From the German patent document DE 727 196 it has been of known art for a long time to connect adjacent fuselage barrels together in the transverse joint region by means of riveted overlap joints to form an aeroplane fuselage. The riveting of the fuselage barrels in the overlap region is conventionally undertaken by means of a plurality of steps. Firstly, the fuselage barrels are arranged relative to one another in an overlap. Pilot holes are then introduced from the exterior into the mutually overlapping fuselage barrel sections. The fuselage barrels are subsequently separated from one another, cleaned and deburred in the overlap region, and provided with a sealant. The fuselage barrels are then once again arranged in an overlap, and are clamped together with temporary connecting elements. Subsequently the pilot holes are sequentially opened out to their final dimensions, and the fuselage barrels are riveted.

For the execution of such a method a device 1 shown in FIG. 1 is conventionally used. The device 1 for the connection of two fuselage barrels 2, 4 in an overlap 6 has two guide rails 8, 10 and a traverse 12. The guide rails 8, define a first axis of movement in the longitudinal direction x of the overlap and serve to accommodate the traverse 12. The traverse 12 defines a second axis of movement in the transverse direction y of the overlap and serves to accommodate a drilling machine 14. While the device, i.e. the drilling machine, does cover a large working area by virtue of the two axes of movement, the method is intrinsically very laborious because of the multiplicity of steps.

The object of the invention is to create a method, which removes the above-cited disadvantages and allows a formation of an overlap joint in a reduced period of time that is simplified in terms of procedure, and also a device for the execution of such a method.

SUMMARY

This object is achieved by means of a method with the steps of Claim 1, and by means of a device with the features of Claim 6.

In an inventive method for the connection of two components in an overlap joint the two components are firstly arranged relative to one another in an overlap, wherein component sections located in the overlap are of integral design with the components, or at least one of the component sections is attached as a separate element to the one component. A drilling machine is then positioned in the region of the overlap. Final dimension holes are then introduced into the components, wherein the component sections, by the introduction of a clamping force by means of a pressure application unit on the traverse side, are pressed together, in the direction of feed of a drill tool clamped in the drilling machine, into the component section close to the drilling machine. The component sections are finally riveted together. The inventive method allows the rapid and simple formation of an overlap joint, since the component sections are pressed together with so great a force that any penetration of chips between the component sections is prevented. The component section remote from the drilling machine is drawn onto the component section close to the drilling machine by means of the pressure application unit such that no temporary connecting elements are necessary. In this manner the steps of moving the components apart, cleaning them, moving them together and tacking them are eliminated. In addition the pilot drilling step is eliminated, since the holes are drilled directly to their final dimensions. In order to avoid any inadvertent detachment of the device from the components, the clamping force is always less than the sum of the forces retaining the guides on the components.

A particularly high clamping action between the component sections is achieved if the clamping force is introduced in the immediate vicinity of the drill tool.

In a preferred example of embodiment a traverse accommodating the pressure application unit is supported by means of a supporting force on the component that has the component section remote from the drilling machine. By this means a counter-support or counter-retainer is created during the application of the clamping force, and the device is correspondingly stabilised. Here, however, care must be taken that the sum of the clamping force and the supporting force is less than the sum of the retaining forces.

In one variant the traverse is supported by means of a supporting force that is nearly identical, or identical, to the clamping force.

In one method tacking holes are firstly drilled for the setting of tacking rivets and the tacking rivets are set. Subsequently rivet holes for the setting of rivets are introduced into the component sections and the rivets are set. By this means the component sections are stabilised relative to one another and are subjected to at least a minimum clamping force. For reasons of economy of method it is particularly advantageous if the tacking holes correspond to the final rivet holes and the tacking rivets correspond intrinsically to the final rivets, so that the tacking rivets, in contrast to the previously mentioned temporary connecting elements of known art, do not have to be replaced.

An inventive device for the execution of a method in accordance with one of the preceding claims for the connection of two components in an overlap joint has a traverse for the accommodation of a drilling machine and two guide rails that can be detachably attached to the components for purposes of supporting the traverse. In accordance with the invention the device has a pressure application unit on the traverse side for purposes of pressing together the components in the region of the overlap by the introduction of a clamping force into a component section close to the drilling machine in the direction of feed of a drill tool clamped in the drilling machine. The pressure application device acts in combination with the guide on the other side of the component section remote from the drilling machine as a quasi-gripper or clamping unit, so that such a device has a high clamping action over a large surface working area and any penetration of chips between the component sections is prevented.

In one example of embodiment the pressure application device has a compression ram, which is positioned in the region of the drill tool and thus in the region of the hole to be introduced in each case. By this means a maximum clamping action is generated in the immediate vicinity of the drill tool.

For purposes of stabilising the device during the application of the clamping force a support unit can be provided on one section of the traverse for the application of a supporting force for purposes of supporting the traverse on the component that has the component section remote from the drilling machine.

In one example of embodiment in which the device is technically simple and robust the support unit is embodied as a quasi-passive system with a support wheel with spring pre-loading. The spring pre-loading ensures moreover that any unevennesses in the region of the running track of the wheel on the component are compensated for.

In one variant the support unit is embodied as an active system and the supporting force is thus adjustable. By this means the support action can be systematically matched to the particular clamping force in question.

Advantageously the device likewise has a riveting facility, which is mounted on the guide rails downstream of the drilling machine, so that a rivet can be set immediately after a hole has been formed.

Other advantageous examples of embodiment of the invention are the subject of further subsidiary claims.

BRIEF DESCRIPTION OF THE DRAWINGS

In what follows preferred examples of embodiment of the invention are elucidated in more detail with the aid of schematic representations. Here.

DETAILED DESCRIPTION

Figure 1:
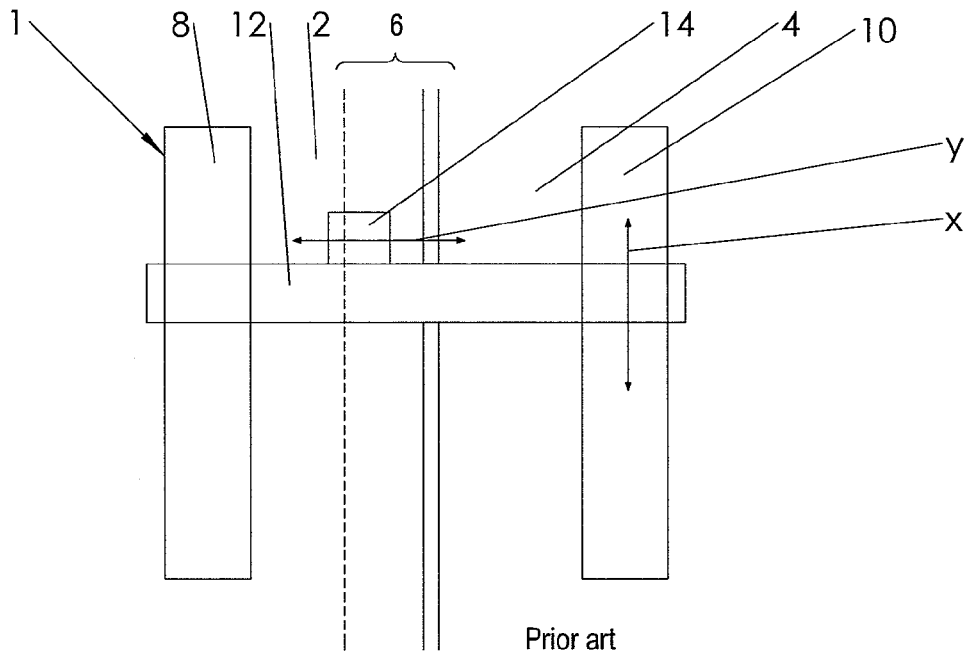
FIG. 1 shows a plan view onto a device in accordance with the prior art.
Figure 2:
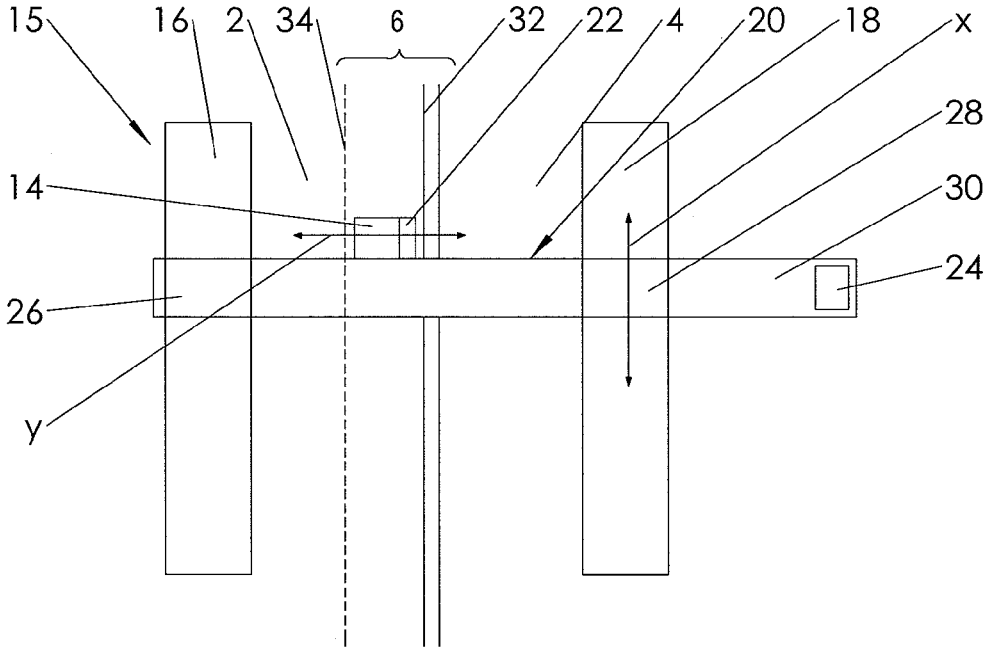
FIG. 2 shows a plan view onto an inventive device in the region of an overlap.

FIG. 2 shows a highly simplified plan view onto an inventive device 15 for the connection of two components 2, 4 in an overlap 6. The device 15 has at least two guide rails 16, 18, a traverse 20, a pressure application device 22, and a support unit 24.

The guide rails 16, 18 serve to provide a detachable attachment of the device to the components 2, 4 and define an axis of movement of a drilling machine 14 in the longitudinal direction x of the overlap 6. For purposes of attachment to components with curved surfaces they are of flexible design. The attachment and detachment of the guide rails 16, 18 to or from the components 2, 4 respectively takes place by means of suction units, not shown, that can be appropriately activated, such as suction feet that can be deaerated and aerated.

The traverse 20 serves to accommodate the drilling machine 14 and defines an axis of movement of the drilling machine 14 in the direction y transverse to the overlap 6. It is mounted with a body section 26, 28 on each of the guide rails 16, 18, such that it can be displaced in the longitudinal direction x of the overlap 6, and has a free end section 30 that extends beyond the right-hand guide rail 18, as represented in the figure, for purposes of accommodating the support unit 24.

Figure 3:
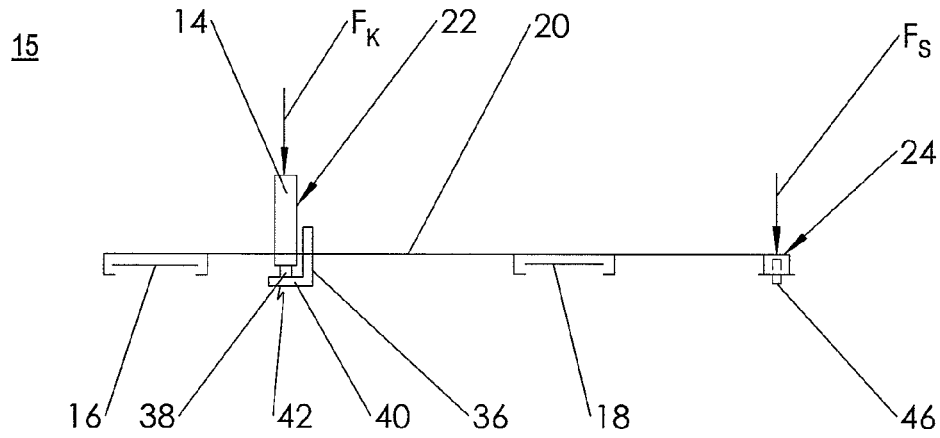
FIG. 3 shows a side view of the inventive device.
Figure 4:
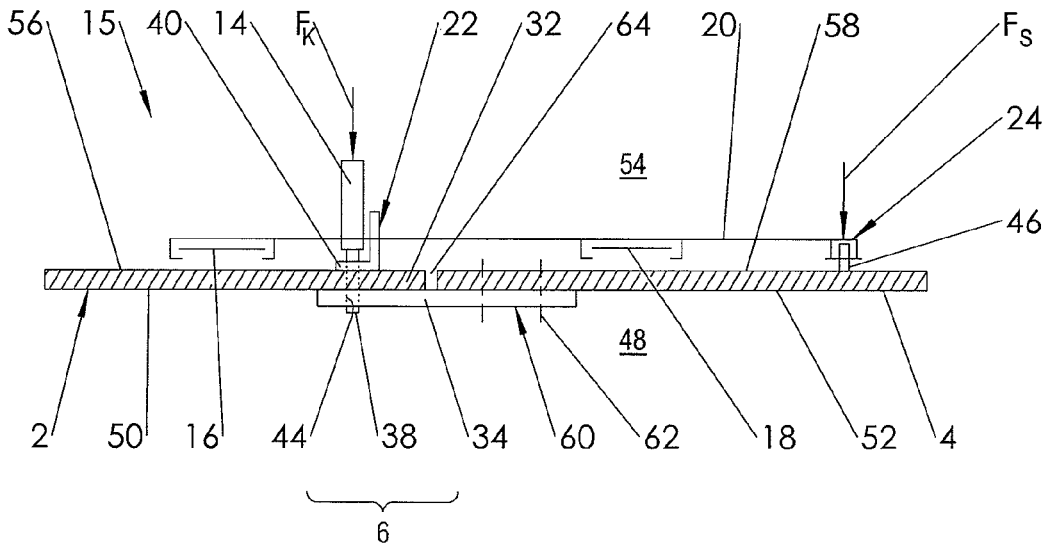
FIG. 4 shows a positioning of the inventive device in the region of an overlap in a side view.

The pressure application unit 22 is attached to the traverse 20 in the region of the drilling machine 14 and serves to apply a clamping force Fk, as represented in FIGS. 3 and 4, for purposes of pressing together the component sections 32, 34 forming the overlap 6.

The support unit 24 is attached on the free end section 30 of the traverse 20 and serves to apply a supporting force Fs, as represented in FIGS. 3 and 4, for purposes of stabilising the device 15 while the component sections 32, 34 are being clamped together.

In accordance with the side view in FIG. 3 the pressure application device 22 on the traverse side is attached in the region of, or on, the drilling machine 14. It has a compression ram 36 for purposes of introducing the clamping force Fk in the direction of feed of a drill tool 38 clamped into the drilling machine 14. The compression ram 36 is appropriately mounted such that it can be traversed in the longitudinal direction of the drill tool 38, and has an angled ram head 40, which with its contact surface 42 can be pressed flat against the component section 32, not shown in this figure, in the immediate vicinity of the drill tool 38. In particular the ram head 40 can have a recess for guiding through and peripherally engaging with the drill tool 38, so that the component sections 32, 34 are pressed together with a maximum clamping action in a ring-shaped region around a hole 44 to be formed, as shown in FIG. 4.

The support unit 24 acts as a counter-support for the device 15 during the introduction of the clamping force Fk. For purposes of application of the supporting force Fs it has a support wheel 46, which can be pre-loaded against the component 4, not shown in this figure, by means of a spring, not shown.

In what follows a preferred example of embodiment of the inventive method with the use of the device 15 is elucidated with the aid of FIG. 4:

Firstly, the components 2, 4 to be connected together in the overlap joint are prepared for the overlap 6. The components 2, 4 are, for example, adjacent fuselage barrels, which are to be connected together in the transverse joint region to form an aeroplane fuselage, whose backing structure, however, is not represented in the interests of clarity. In principle, however, the formation of an overlap joint in the longitudinal seam region of skin fields forming the fuselage barrels 2, 4, is also possible. The fuselage barrels 2, 4 preferably consist of a light metal or a light metal alloy, but can however also be of a plastic material reinforced with carbon fibres, glass fibres, aramide fibres and similar. Moreover, it can have a metal-plastic sandwich structure, such as GLARE.

The fuselage barrels 2, 4 have in each case an inner surface, 50, 52 facing towards a cabin interior 48, and an outer surface 56, 58 facing towards an external environment 54. For purposes of preparing the overlap 6, an edge region of the right-hand fuselage barrel 4 in FIG. 4 is designed in the form of a step. For this purpose a strap 60 projecting in the axial direction is attached by means of rivets 62 to the fuselage barrel 4 on its inner surface; in this manner it forms a body section of the fuselage barrel 4. Of course, however, the strap 60 can also be designed integrally with one of the fuselage barrels 4.

The fuselage barrels are then arranged relative to one another in an overlap 6, wherein an edge region of the left-hand fuselage barrel 2 forms a radially outer-lying, i.e. close to the drilling machine, component section 32 of the left-hand fuselage barrel 2 and the strap 60 with its projecting body region forms a radially inner-lying, i.e. remote from the drilling machine, component section 34 of the right-hand fuselage barrel 4. An axial gap 64 is thereby preferably formed between opposing outer surface edges, not numbered; the gap is closed by means of a sealant. For purposes of compensating component tolerances between the component sections 32, 34, a sealant is applied to one of the component sections 32, 34, before the fuselage barrels 2, 4 are pushed together.

After the arrangement of the fuselage barrels 2, 4 in the overlap 6, the device 15 is attached by means of its guide rails 16, 18 to the fuselage barrels 2, 4 such that the drilling machine 14 is positioned on the outer environment side between the guide rails 16, 18, in the region of the overlap 6 and the traverse 20 is moreover supported by means of the support wheel 46 of the support unit 24 on the right-hand fuselage barrel 4. For this purpose the guide rails 16, 18 are detachably attached on either side of the overlap 6 to the outer surfaces 56, 58 of the fuselage barrels 2, 4, by means of a multiplicity of vacuum fields, not represented.

Then, by traversing the drilling machine 14 in the longitudinal direction x and the transverse direction y, and also by lowering the rotating drill tool, 38, a multiplicity of holes 44 are introduced into the mutually overlapping component sections 32, 34, wherein preferably tacking holes are first formed for purposes of setting tacking rivets, and then, after the setting of the tacking rivets, rivet holes are formed for purposes of setting the retaining rivets. Here the tacking holes are identical to the rivet holes, and are already drilled to their final dimensions in one drilling process. For this purpose the drill tool 38 has appropriate tool sections, including a countersink section for purposes of forming a countersink for the rivet heads. Likewise, the tacking rivets are identical to the retaining rivets. The setting of the rivets is undertaken by means of a riveting facility, not shown, downstream of the drilling machine 14, which is mounted on the guide rails 16, 18 such that it can traverse in the longitudinal direction x and the transverse direction y.

In order to avoid any penetration of chips between the component sections 32, 34, while the final dimension holes 44 are being formed, for each drilling process the ram head 40 of the pressure application unit 22 is preferably lowered onto the component section 32 close to the drilling machine and the clamping force Fk is introduced by means of the ram head 40 into the overlap 6 orthogonally to the outer surface 56, in the direction of feed of the drill tool 38. In principle, the clamping force can also be maintained while the drilling machine 14 is being traversed in the longitudinal direction x and the transverse direction y, but this can lead to significant loading of the guide rails 16, 18. Since the traverse 20 is attached with its own guide rail 18 to the fuselage barrel 4, which forms the component section 34 remote from the drilling machine, the latter is quasi-lifted and the component sections 32, 34 are pressed together. In order to avoid any detachment of the device 15 from the fuselage barrels 2, 4, the clamping force Fk is, however, less than the sum of the retaining forces of the suction feet of the guide rails 16, 18. At the same time the traverse 20 is stabilised by means of the support unit 24 acting as a counter-support. Here the support wheel 46 with spring pre-loading supports itself on the fuselage barrel 4 forming the component section 34 remote from the drilling machine 14, and prevents any quasi-rotational movement of the traverse 20 in the clockwise sense about the right-hand guide rail 18, which is arranged between the pressure application unit 22 and the support unit 24, and thus any detachment of the device 15 from the components 2, 4. The pressure application unit 22 and the support unit 24 are preferably spaced apart at an equal or similar distance in the transverse direction y from the guide rail 18, so that the supporting force Fs is approximately, or exactly, equal to the clamping force Fk.

Disclosed are a method and a device for the connection of two components indirectly or directly in an overlap joint, wherein component sections located in the overlap are pressed together for each drilling procedure by means of a clamping unit formed from a pressure application device on the drilling machine side and a guide on the component side, such that any penetration of chips between the component sections is prevented and temporary connecting elements can be dispensed with.

The invention claimed is:

1. A method for the connection of two components in an overlap joint, comprising:

arranging of the two components in an overlap, wherein component sections located in the overlap are of integral design with the two components or at least one of the component sections is attached as a separate element to one component;

positioning of a drilling machine in a region of the overlap;

introducing of final dimension holes into the component sections;

introducing a clamping force in a direction of feed of a drill tool clamped in the drilling machine into a component section close to the drilling machine by means of a pressure application unit on a drilling machine side, wherein a traverse defining an axis of movement of the drilling machine in a direction transverse to the overlap and accommodating the pressure application unit is supported by two guide rails detachably attached to the components, a support unit is provided on the traverse for application of a supporting force for supporting the traverse on the component that has the component section remote from the drilling machine, the support unit and the pressure application unit are spaced apart in a traverse direction from one of the guide rails, the supporting force having the same direction as the clamping force, wherein the pressure application unit is movable between the two guide rails along the traverse and the support unit is disposed on a free end section of the traverse and not directly attached to either of the two guide rails; and riveting of the component sections.

2. The method in accordance with claim 1, wherein the clamping force is introduced in the immediate vicinity of the drill tool.

3. The method in accordance with claim 1, wherein the supporting force for supporting the traverse is equal to the clamping force.

4. The method in accordance with claim 1, wherein firstly tacking holes, and then rivet holes are formed.

5. The method in accordance with claim 1, wherein the support unit and the pressure application unit are disposed on opposite sides of one of the guide rails and are spaced from each of the two guide rails.

6. A device for the execution of a method for the connection of two components in an overlap joint, comprising:

a traverse for the accommodation of a drilling machine, the traverse defining an axis of movement of the drilling machine in a direction transverse to the overlap joint;

two guide rails detachably attached to the components for supporting the traverse;

a pressure application unit on a traverse side for pressing together the components in a region of the overlap by means of introduction of a clamping force into a component section close to the drilling machine in a direction of feed of a drill tool clamped in the drilling machine, wherein the pressure application unit is movable between the two guide rails along the traverse; and a support unit provided on a free end section of the traverse section for application of a supporting force for supporting the traverse on the component that has a component section remote from the drilling machine, wherein the support unit is not directly attached to either of the two guide rails, wherein the support unit and the pressure application unit are spaced apart in a traverse direction from one of the guide rails, the supporting force having the same direction as the clamping force.

7. The device in accordance with claim 6, wherein the pressure application unit includes a compression ram, which is positioned in the region of the drill tool.

8. The device in accordance with claim 6, wherein the support unit includes a support wheel with spring pre-loading.

9. The device in accordance with claim 6, wherein the supporting force is adjustable.

10. The device in accordance with claim 6, wherein a riveting facility is mounted on the guide rails downstream of the drilling machine.

11. The device in accordance with claim 6, wherein the support unit and the pressure application unit are disposed on opposite sides of one of the guide rails and are spaced from each of the two guide rails.

* * * * *